US011035092B2

(12) United States Patent
De Vries et al.

(10) Patent No.: US 11,035,092 B2
(45) Date of Patent: Jun. 15, 2021

(54) SYSTEM AND METHOD OF MONITORING A UTILITY STRUCTURE

(71) Applicant: Consolidated Edison Company of New York, Inc., New York, NY (US)

(72) Inventors: Troy David De Vries, Mahwah, NJ (US); Zhou Zheng, Brooklyn, NY (US); Stanley J. Lewis, Garden City, NY (US); Leslie George Philp, Pelham, NY (US); Colleen Bridget Murach, Red Bank, NJ (US); Gregg L. Slintak, Monroe, NH (US)

(73) Assignee: CONSOLIDATED EDISON COMPANY OF NEW YORK, INC., New York, NY (US)

( * ) Notice: Subject to any disclaimer, the term of this patent is extended or adjusted under 35 U.S.C. 154(b) by 0 days.

(21) Appl. No.: 16/504,715

(22) Filed: Jul. 8, 2019

(65) Prior Publication Data

US 2019/0330818 A1 Oct. 31, 2019

Related U.S. Application Data

(63) Continuation of application No. 15/722,447, filed on Oct. 2, 2017, now Pat. No. 10,344,446.

(51) Int. Cl.
*E02D 29/14* (2006.01)
*E05F 15/60* (2015.01)

(52) U.S. Cl.
CPC ..... *E02D 29/14* (2013.01); *E02D 29/1472* (2013.01); *E02D 29/1481* (2013.01); *E02D 29/1427* (2013.01); *E05F 15/60* (2015.01)

(58) Field of Classification Search
CPC . E02D 29/14; E02D 29/1481; E02D 29/1472; E02D 29/1427; E05F 15/60
See application file for complete search history.

(56) References Cited

U.S. PATENT DOCUMENTS 5,531,099 A 7/1996 Russo
5,565,783 A 10/1996 Lau et al.
5,583,492 A 12/1996 Nakanishi et al.
6,611,755 B1 * 8/2003 Coffee ..... B28C 5/422 340/438
7,598,858 B2 10/2009 Quist et al.
(Continued)

*Primary Examiner* — Afshawn M Towfighi
(74) *Attorney, Agent, or Firm* — Cantor Colburn LLP

(57) ABSTRACT

A system for monitoring a structures containing utility components is provided. The system includes a sensing devices, each being disposed within a structure and distributed within a geographic region, each of the sensing devices measuring parameters within the structure. A display is coupled to the sensing devices and is positioned remotely therefrom. One or more processors communicate with the sensing devices and the display. Wherein the processors perform a method comprising: receiving the measured parameters; comparing the measured parameters to thresholds; displaying on the display device elements, each device element representing one of the sensing devices, each of the device elements being geometrically arranged on the geographic distribution of the sensing devices; displaying on the display a plurality of elements, each associated with one of the device elements; and changing at least one of the elements when a measured parameter crossing one of the thresholds.

11 Claims, 12 Drawing Sheets

(56) References Cited

U.S. PATENT DOCUMENTS

| | | | | |
|---|---|---|---|---|
| 7,701,356 | B2 | 4/2010 | Curt et al. | |
| 7,768,413 | B2 * | 8/2010 | Kosuge | E03F 7/00 340/612 |
| 7,944,352 | B2 | 5/2011 | Drake et al. | |
| 8,237,576 | B2 | 8/2012 | Wander | |
| 8,258,977 | B1 | 9/2012 | Montestruque | |
| 8,976,038 | B2 | 3/2015 | Miller, II et al. | |
| 9,546,466 | B2 | 1/2017 | Wander | |
| 10,344,446 | B2 * | 7/2019 | De Vries | E02D 29/14 |
| 2015/0197913 | A1 | 7/2015 | Wander | |
| 2018/0025458 | A1 | 1/2018 | Swamy | |
| 2019/0100895 | A1 | 4/2019 | De Vries | |

* cited by examiner

| Device ID | Installed Date | Structure Location | Signal Strength (dBm) | Sensor 1 (PPM) | Sensor 2 (Volt) |
|---|---|---|---|---|---|
| 88378 | 5/11/2017 | 25730 | -80 | 8 | 2 |
| 78097 | 3/15/2017 | 28536 | -80 | 26 | 1 |
| 96288 | 3/27/2017 | 13577 | -71 | 18 | 1 |
| 71398 | 4/3/2017 | 40471 | -113 | 7 | 5 |
| 88001 | 6/7/2017 | 9468 | -99 | 13 | 2 |
| 88930 | 3/6/2017 | 42225 | -66 | 2 | 0 |
| 87177 | 4/30/2017 | 25477 | -108 | 6 | 0 |
| 89751 | 4/18/2017 | 28348 | -65 | 50 | 0 |
| 73378 | 5/11/2017 | 17231 | -101 | 14 | 0 |
| 79897 | 5/3/2017 | 27067 | -76 | 42 | 5 |
| 93477 | 5/21/2017 | 4127 | -72 | 8 | 0 |
| 97521 | 5/1/2017 | 20333 | -91 | 30 | 5 |

SYSTEM AND METHOD OF MONITORING A UTILITY STRUCTURE

CROSS-REFERENCE TO RELATED APPLICATIONS

The present application is a continuation application of U.S. patent application Ser. No. 15/722,447 filed on Oct. 2, 2017, the contents of which are incorporated by reference herein.

BACKGROUND

The subject matter disclosed herein relates to a system and method of monitoring, managing and working in spaces or structures that include electrical utility equipment, and in particular to a system and method of remotely determining an undesired condition and taking appropriate action.

Electrical utilities have a number of metrics that are used to track performance and customer satisfaction. These metrics, which include the system average interruption frequency index ("SAIFI"), the customer average interruption duration index ("CAIDI"), and for some utilities, the momentary average interruption frequency index ("MAIFI"). SAIFI measures the average number of interruptions that a customer would experience during a time period, such as a year. CAIDI measures the duration of the interruption that a customer would experience, and is generally a few hours per year. MAIFI measures the number of power interruptions that have a duration of less than five minutes that a customer would experience during a given time period.

Some or all of these metrics are also used by government regulators to aid in determining if the electrical utility is adhering to the regulations in maintaining a durable and reliable electrical distribution network. As a result, electrical utility and distribution companies have developed system architectures that minimize the duration and frequency of power outages.

It should be appreciated that as a result of these metrics, electrical utilities have incentive to maintain equipment in operating order and to quickly determine when a condition occurs that is either impacting the distribution of electrical power or has the potential to effect reliability of the electrical network. Often conditions are monitored by utility personnel who visually inspect and perform measurements on electrical equipment and facilities where it is located. In a large metropolitan area, the electrical utility may maintain a large staff of utility personnel that are distributed over a wide geographic area. This staffing of utility personnel represents a large investment for the electrical utility and it may be difficult to cost effectively dispatch the utility personnel with the desired skills and tools in a rapid manner.

Accordingly, while existing monitoring systems are suitable for their intended purposes the need for improvement remains, particularly in providing a system that allows for remote sensing and transmission of data to a centralized control and the automated dispatching of utility personnel.

BRIEF DESCRIPTION

According to one aspect of the disclosure a system for monitoring a plurality of structures containing utility components is provided. The system comprising: a plurality of sensing devices, each being disposed within one of the plurality of structures, the plurality of sensing devices being distributed within a geographic region, each of the sensing devices having a plurality of sensors for measuring parameters within the associated structure; a display operably coupled to the plurality of sensing devices, the display being positioned remotely from the plurality of sensing devices; one or more processors coupled for communication to the plurality of sensing devices and the display. Wherein the one or more processors are responsive to executable instructions when executed on the processor for performing a method comprising: receiving signals representing the measured parameters; comparing the measured parameters to predetermined thresholds; displaying on the display a plurality of device elements, each device element representing one of the plurality of sensing devices, each of the plurality of device elements being geometrically arranged based at least in part on the geographic distribution of the plurality of sensing devices; displaying on the display a plurality of elements, each of the plurality of elements being associated with one of the plurality of device elements; and changing at least one of the plurality of elements in response to one of the measured parameters crossing one of the predetermined thresholds.

According to another aspect of the disclosure a method of prioritizing and dispatching utility personnel to one or more of a plurality of structures containing utility components, the method comprising: disposing at least one sensing device in each of the plurality of structures, the structures being distributed within a geographic region, each of the sensing devices having a plurality of sensors for measuring parameters within the associated structure; measuring, with each sensing device, the measured parameters at each structure; transmitting the measured parameters to one or more processors located at a central processing center, the central processing center being remotely located from the plurality of structures; comparing the measured parameters to predetermined first thresholds; determining a first plurality of structures, each having at least one measured parameter that crossed a first threshold; prioritizing with the one or more processors the first plurality of structures for repair, the prioritizing being based at least in part on a predetermined criterion; determining with the one or more processors a plurality of available operational personnel for repairing the first plurality of structures; and dispatching the plurality of available operational personnel to the first plurality of structures based on the prioritization.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments of the present invention provide for a system that allows for the automated or intelligent remote monitoring, asset management and safe work in and around facilities that include utility equipment. Embodiments of the present invention provide for a system that measures multiple parameters related to a facility that includes utility equipment. Still further embodiments of the present invention provide for a system that monitors a plurality of remote sensors disposed at facilities having utility equipment and prioritizes the order in which issues will be addressed. Still further embodiments of the present invention provide for the automatic assigning and dispatching of utility personnel based on the prioritization. Still further embodiments enhance the working conditions for personnel working in and around a utility facility with knowledge of the environmental conditions of the facility they are working on, as well as the surrounding facilities.

Figure 1:
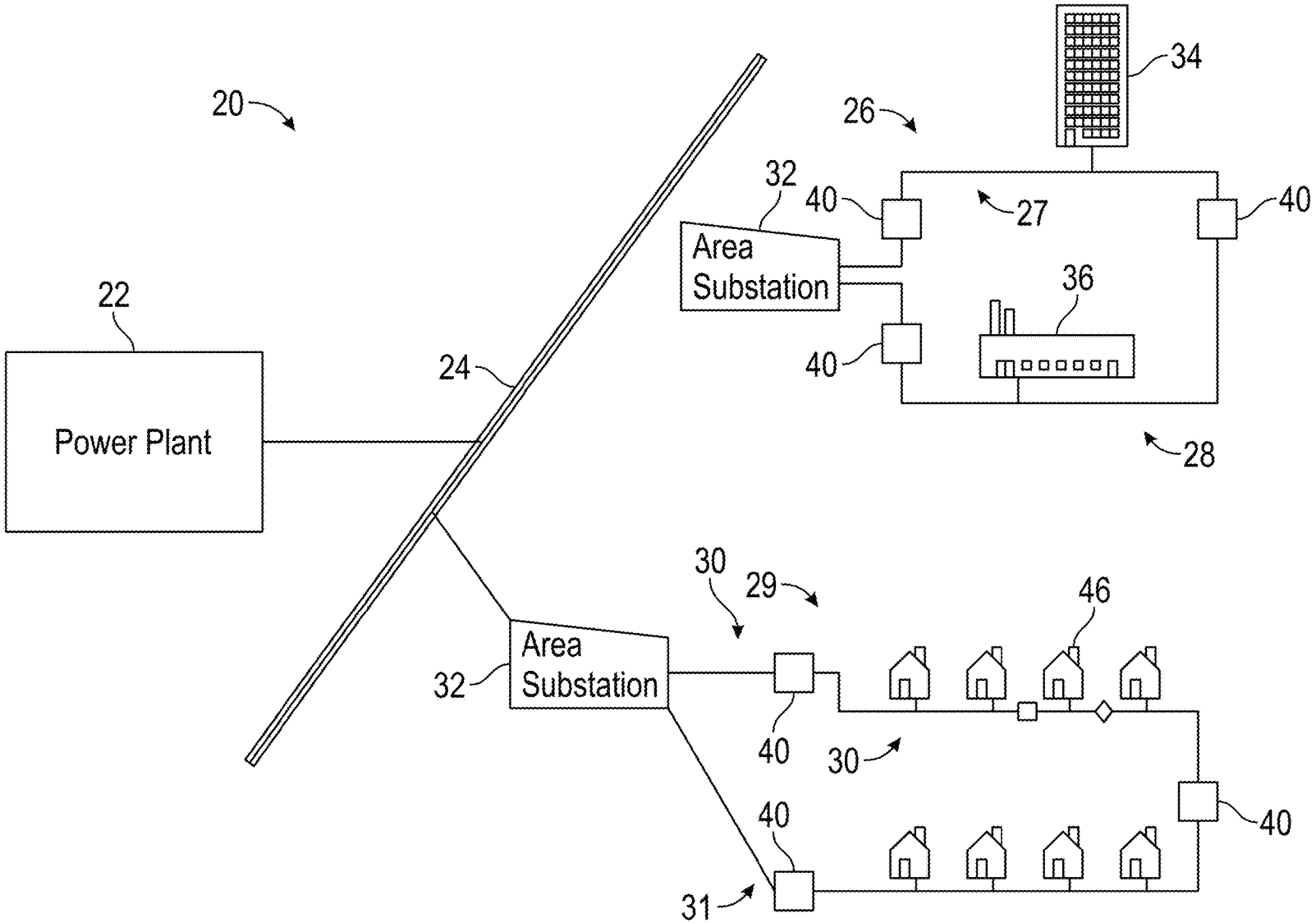
FIG. 1 is a schematic illustration of a utility electrical distribution system.

Referring now to FIG. 1, an embodiment is shown of a utility electrical distribution system 20. The utility system 20 includes one or more power plants 22 connected in parallel to a main transmission system 24. The power plants 22 may include, but are not limited to: coal, nuclear, natural gas, or incineration power plants. Additionally, the power plant 22 may include one or more facilities that generate electricity based on renewable energy sources, such as but not limited to hydroelectric, solar, or wind turbine power plants. It should be appreciated that additional components such as transformers, switchgear, fuses and the like (not shown) may be incorporated into the utility system 20 as needed to ensure the efficient operation of the system. The utility system 20 is typically interconnected with one or more other utility networks to allow the transfer of electrical power into or out of the electrical system 20.

The main transmission system 24 typically consists of high transmission voltage power lines, anywhere from 69 KV to 500 KV for example, and associated transmission and distribution equipment which carry the electrical power from the point of production at the power plant 22 to the end users located on local electrical distribution systems 26, 29. The local distribution systems 26, 29 are connected to the main distribution system by area substations 32 which reduce transmission voltage to distribution levels such as 13 KV, 27 KV or 33 KV. Area Substations 32 typically contain one or more transformers, switching, protection, and control equipment. Area Substations 32 all include circuit breakers to interrupt faults such as short circuits or over-load currents that may occur. Substations 32 may also include equipment such as fuses, surge protection, controls, meters, capacitors, and load tap changers for voltage regulation.

The area substations 32 connect to one or more local electrical distribution systems, such as local distribution system 26, for example, that provides electrical power to a commercial area having end users such as an office building 34 or a manufacturing facility 36. In an embodiment, the area substation 32 may have two or more feeder circuits that provide electrical power to different feeder circuit branches 27, 28 of the local distribution system 26.

The residential distribution system 29 includes one or more residential buildings 46 and light industrial or commercial operations. Similar to the commercial distribution network 26, the residential system 29 is divided into multiple branch feeders 30, 31 that are fed by the substation 32. In an embodiment, the local distribution system 29 is arranged such that approximately up to 6 MVA of power is provided on each branch circuit for electrical loads such as residential buildings.

Figure 2A:
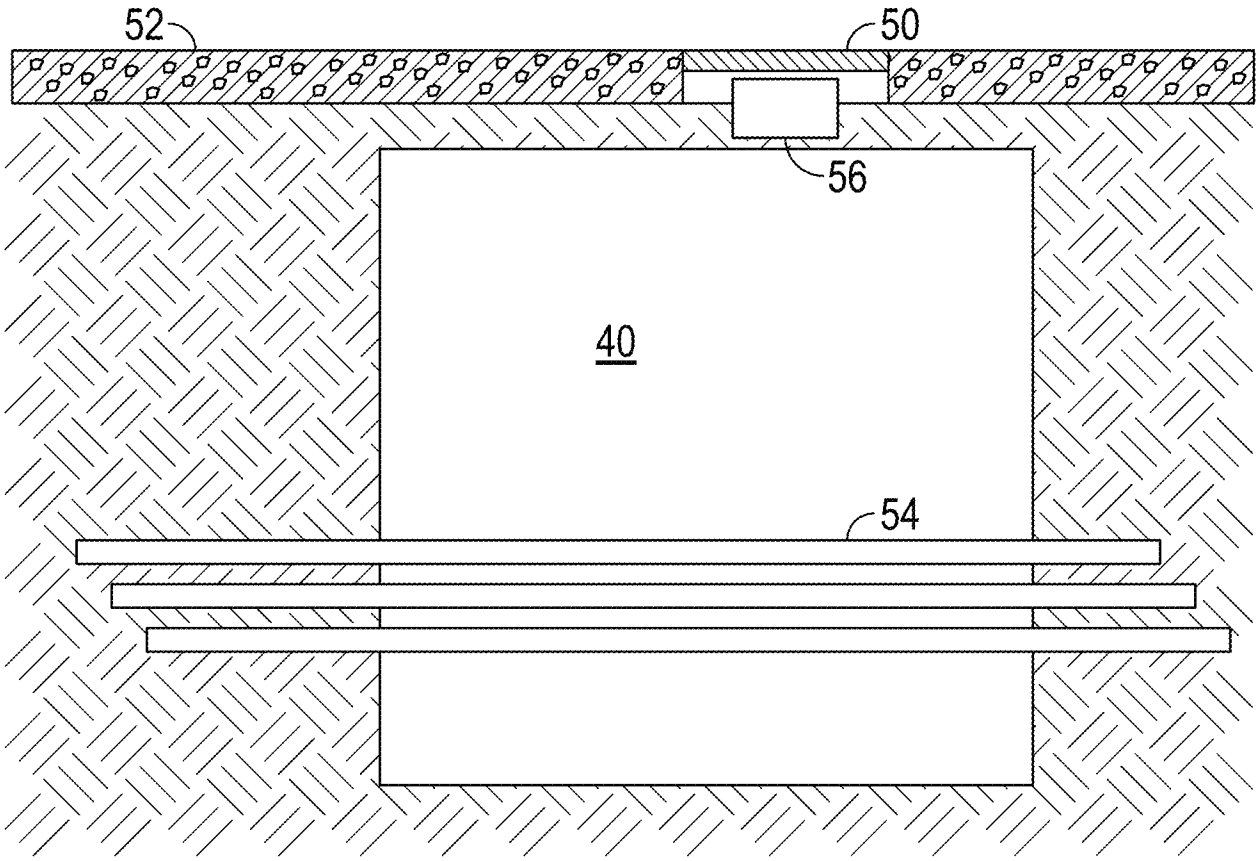
FIG. 2A and FIG. 2B are illustrations of a subterranean space or structure that includes utility equipment.

It should be appreciated that the distribution systems 26, 29 may include facilities, such as underground chambers or structures 40 that house equipment or provide the electrical utility access to electrical conductors 54 (e.g. power lines). These subterranean or underground structures 40 are typically accessed by an opening in the ground, such as in a sidewalk or street 52. The openings are enclosed by a cover, also referred to as a manhole cover 50 (FIG. 2). It should be appreciated that it is desirable to monitor the conditions within the structure 40, such as for the presence of undesired matter (e.g. water or gases) or undesired operating states (e.g. elevated conductor 54 temperature). To monitor these conditions, the structure 30 includes a remote monitoring device 56 that includes a plurality of sensors. As will be discussed in more detail herein, the monitoring device 56 may be sized to fit through slots formed in the manhole cover 50 and be suspended beneath the manhole cover 50 within the structure 40.

Figure 3A:
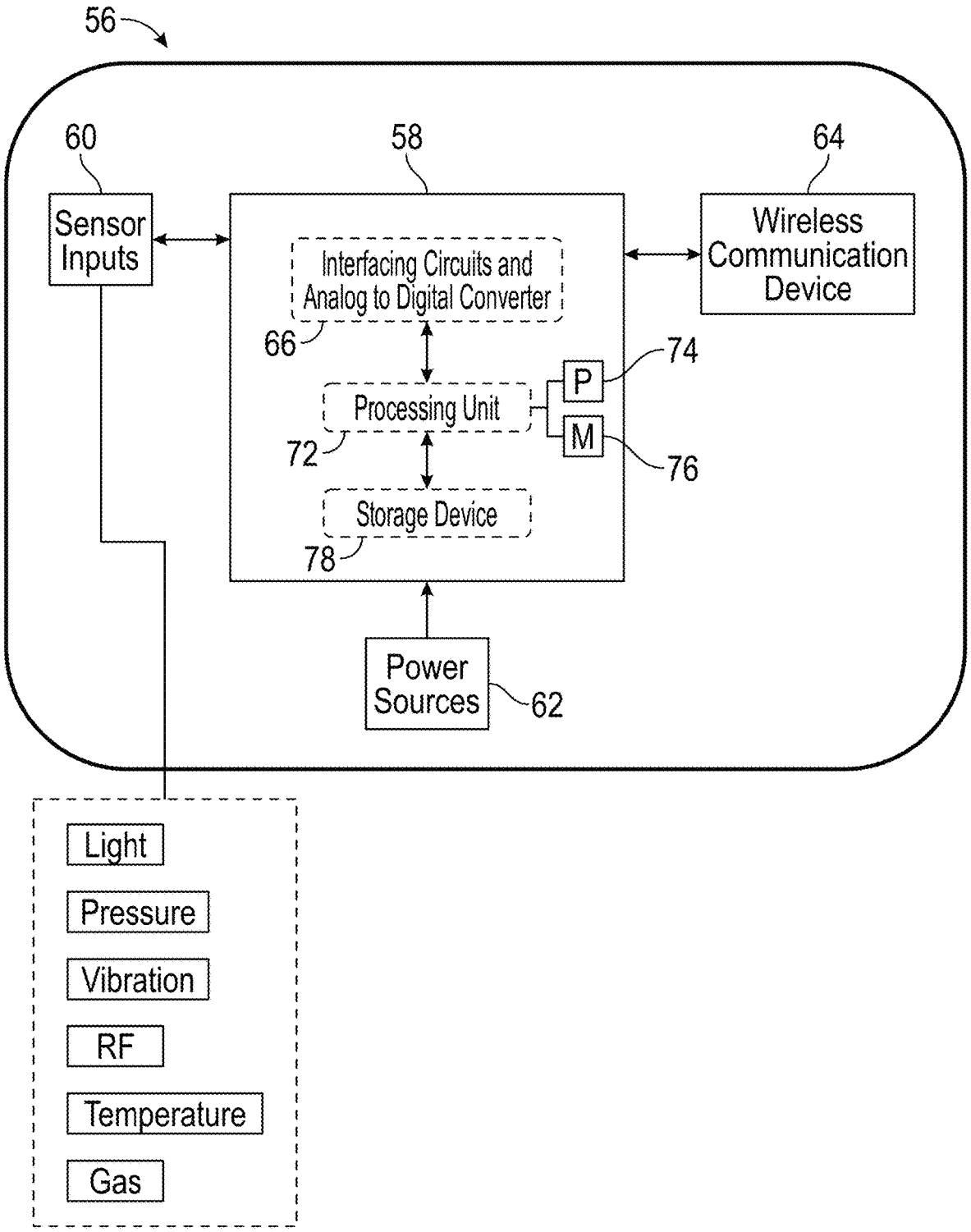
FIG. 3A is a schematic illustration of a remote monitoring system for use at the subterranean space or structure of FIG. 2.

Referring now to FIG. 3A, a schematic illustration is shown of the remote monitoring device 56. The remote monitoring device 56 includes a controller 58 that receives inputs from one or more sensors 60, a power source 62 (e.g. a battery and/or cable power harvesting unit) and a wireless communications device 64. In an embodiment, the power source 62 is a battery sized to have a 5 to 8 year expected operating life. The operation of remote monitoring device 56 is controlled by controller 58. Controller 58 is a suitable electronic device capable of accepting data and instructions, executing the instructions to process the data, and presenting the results. Controller 58 may accept instructions through a user interface, or through other means such as but not limited to electronic data card, voice activation means, manually-operable selection and control means, radiated wavelength and electronic or electrical transfer.

Controller 58 is capable of converting the analog voltage or current level provided by sensor(s) 60 into a digital signal indicative of the level of water, the presence of a particular gas above a threshold or the conductors 54 operating at a temperature above a threshold for example. In some embodiments, the sensor(s) 60 may measure parameters that include but not limited to light levels, pressure levels, vibration levels, the presence of radio frequency signals, temperature within the structure 40, temperature of a conductor 54, and the presence of predetermined gases and the like. Alternatively, sensor(s) 60 may be configured to provide a digital signal to controller 58, or an analog-to-digital (A/D) converter 66 maybe coupled between sensor(s) 60 and controller 58 to convert the analog signal provided by sensor(s) 60 into a digital signal for processing by controller 58. The digital signals act as input to various processes within controller 58 for purposes of controlling the remote monitoring device 56.

Figure 3B:
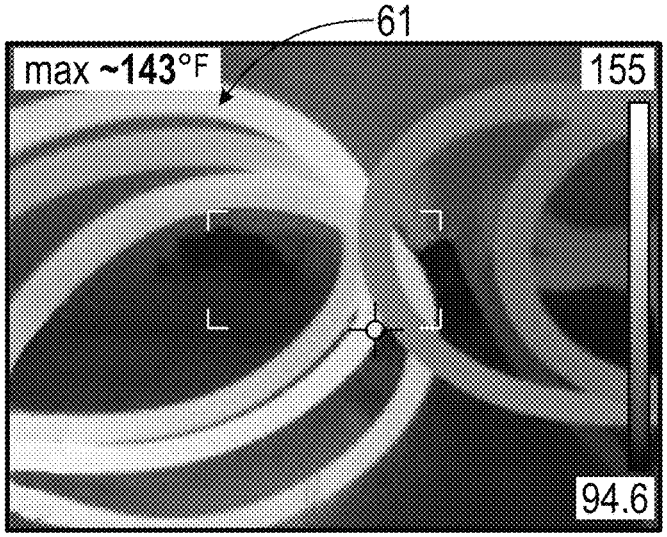
FIG. 3B, FIG. 3C and FIG. 3D illustrate thermal images measured by the remote monitoring system of FIG. 3A.
Figure 3C:
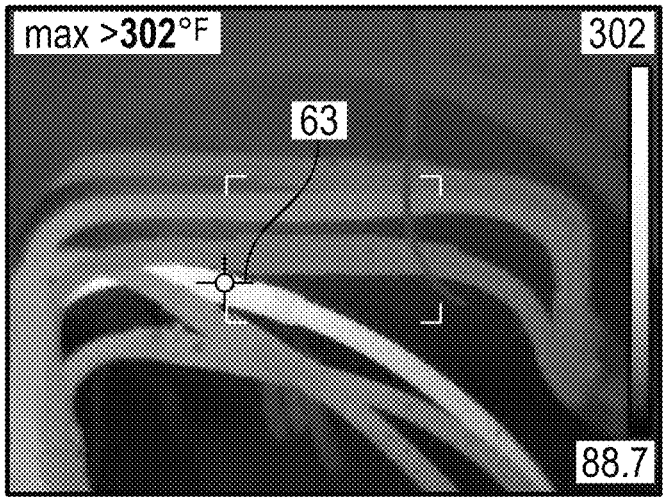
Figure 3D:
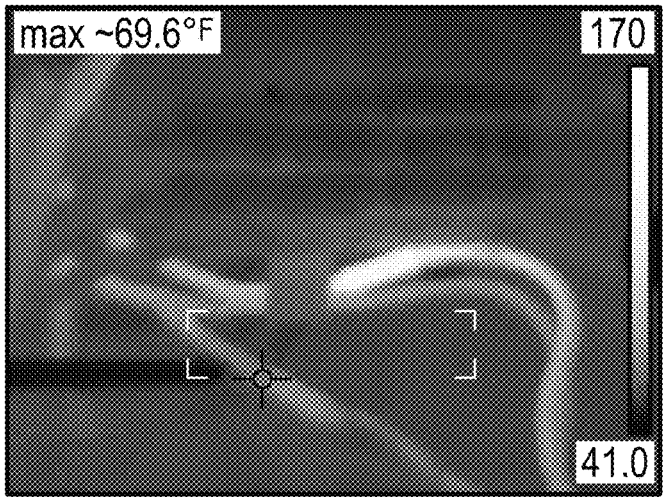
Figure 4:
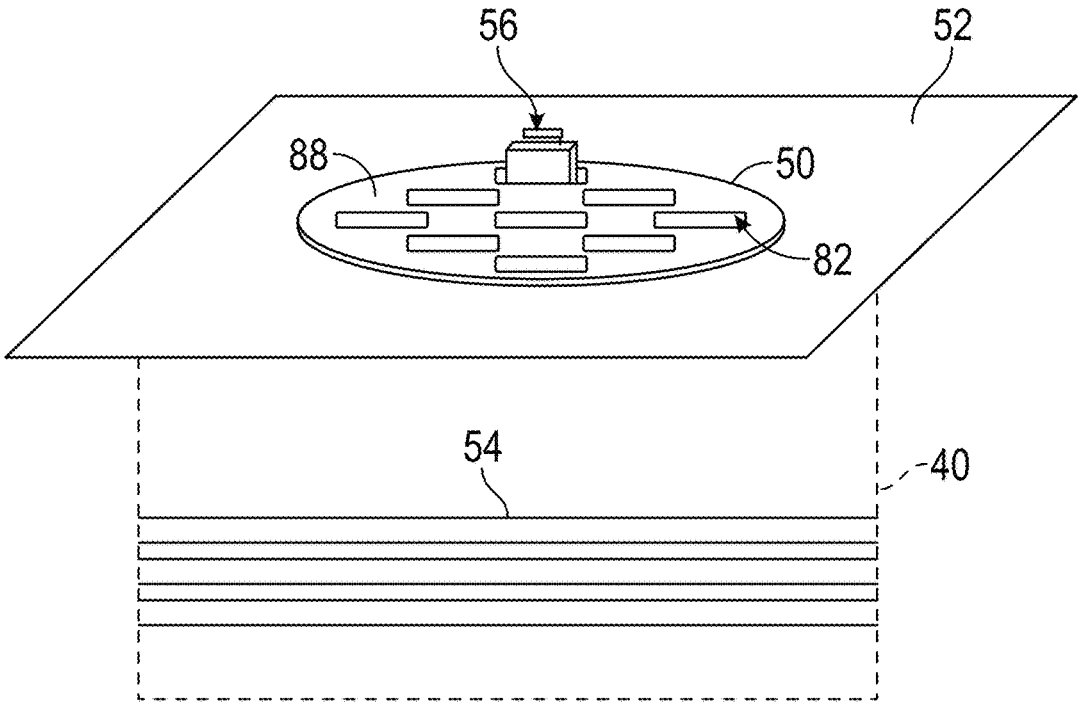
FIG. 4 is a schematic perspective illustration of a manhole cover for the subterranean space or structure of FIG. 2 with the monitoring system being installed.
Figure 5:
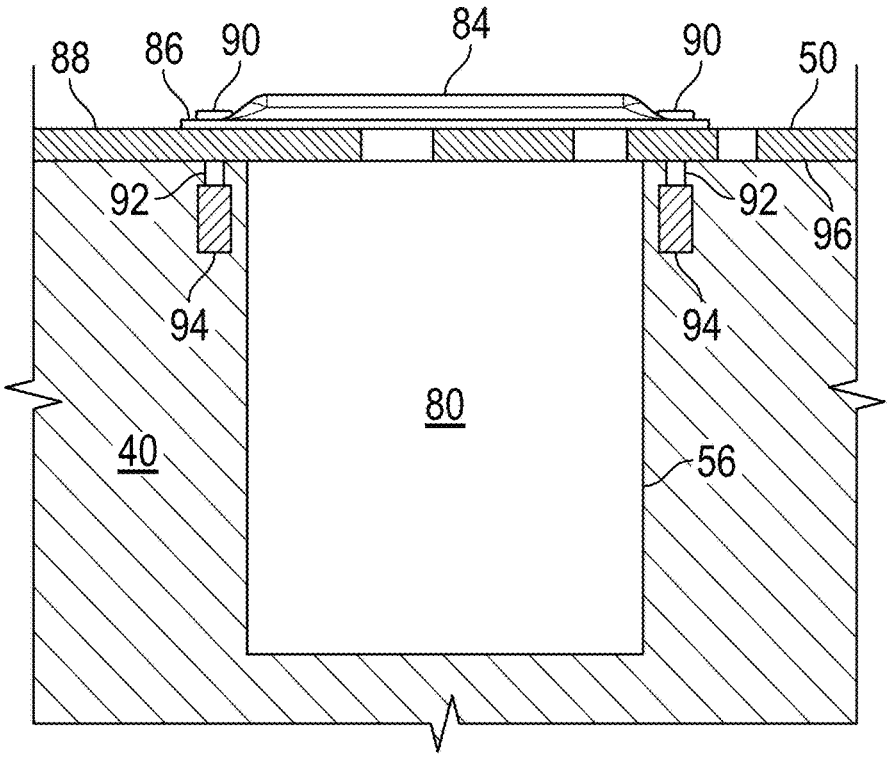
FIG. 5 is a side view of the manhole cover of FIG. 4 with the monitoring system installed.
Figure 6:
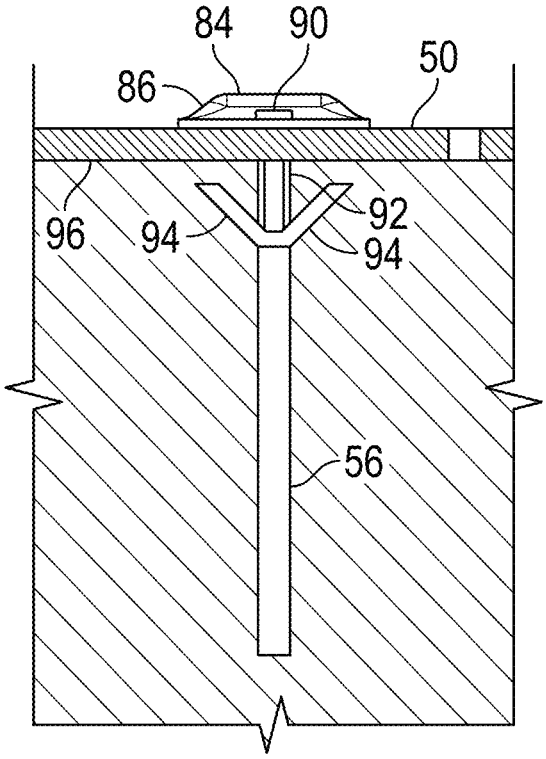
FIG. 6 is an end view of the manhole cover of FIG. 4 with the monitoring system installed.
Figure 7:
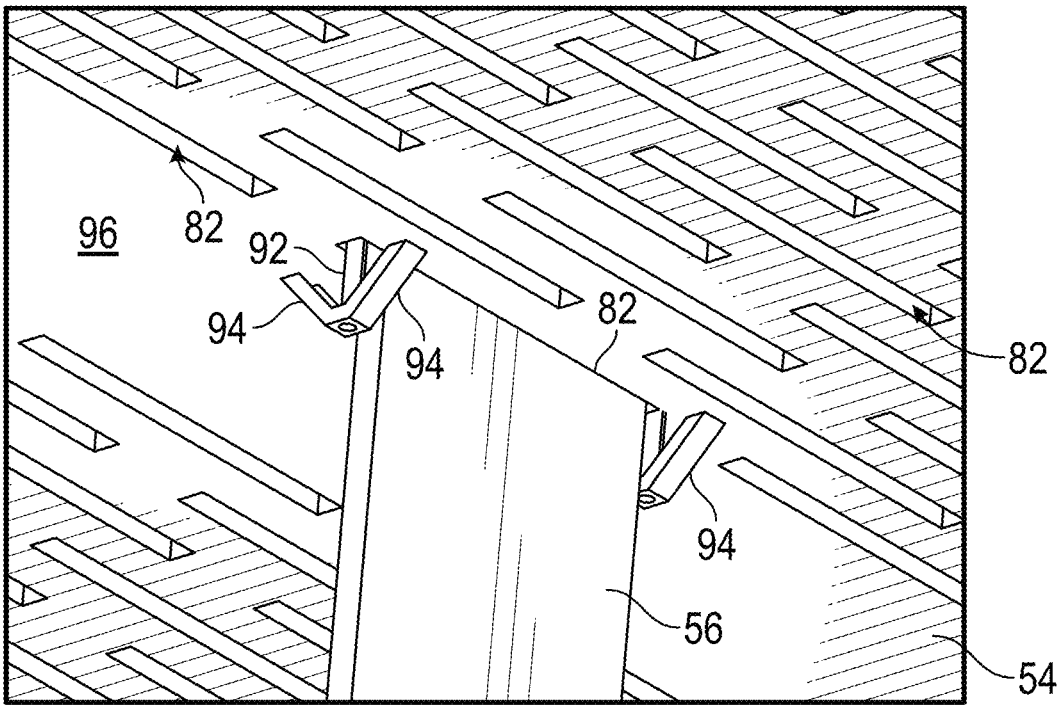
FIG. 7 is a perspective view of the underside of the manhole cover of FIG. 4 with the monitoring system installed.

In an embodiment, the sensor(s) 60 include sensing devices that measure one or more of combustible gas (e.g 0.5% LEL and 1.0% LEL), stray and contact voltage (e.g. contact voltage between 1V and 5V), infrared image signatures (e.g. a hot spot 63 of FIG. 3C), temperatures (e.g. 75 C and 90 C, or air temperature between 50%-75% of conductor cable rating), particulate size (e.g. 1micron-10 micron), voltage (e.g. 0V—nominal line voltage), water level (e.g. water level over the height of the sensor), and electrical arcing (e.g. sub cycle faults). In another embodiment, the sensing devices measure one or more measurement parameters that include thermal or visible parameters, such as those shown in FIGS. 3B-3D. In an embodiment, the sensor(s) 60 measure temperature and uniformity across a segment of cable and/or connections (e.g. substantially uniform measurements exceeding the rating ≥90 C may indicate an overload, such as cable 61 of FIG. 3B). In an embodiment, the temperature differential across a segment of cable and/or connections is determined and compared to a predetermined threshold (e.g. ≥17 C) to identify a possible defect (FIG. 3D). In an embodiment, a single temperature is compared to a predetermined threshold (e.g. ≥110 C) to identify a possible defect. In an embodiment, the measurement parameter is a sound pressure level (e.g. ≥90 dB). In an embodiment, a visible image is acquired by the sensor(s) 60 and an opacity is determined (e.g. ≥5%). In an embodiment, the sensor(s) 60 measure one or more of sound, and fluorescence. In one embodiment, the time period between the wireless communication from a remote device 56 to the collecting device 100 is measured. When the time period is greater than a threshold (e.g. a remote device has potentially failed), an indication is provided.

Controller 58 is operably coupled with one or more components of device 56 by data transmission media. Data transmission media includes, but is not limited to, twisted pair wiring, coaxial cable, and fiber optic cable. Data transmission media also includes, but is not limited to, wireless, radio and infrared signal transmission systems.

Figure 8:
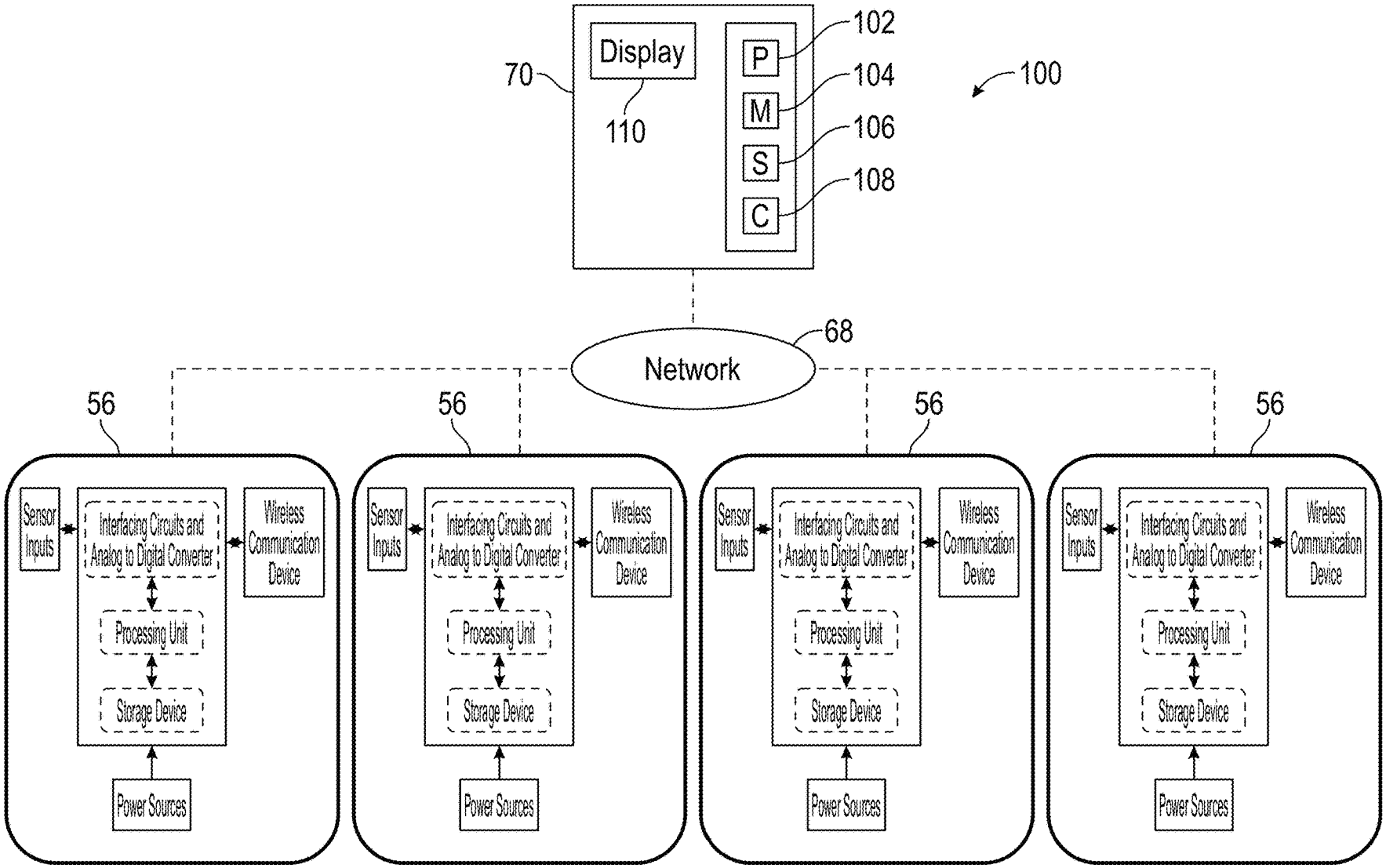
FIG. 8 is a schematic illustration of a system for remotely collecting and monitoring data from the monitoring systems of FIG. 3.
Figure 9:
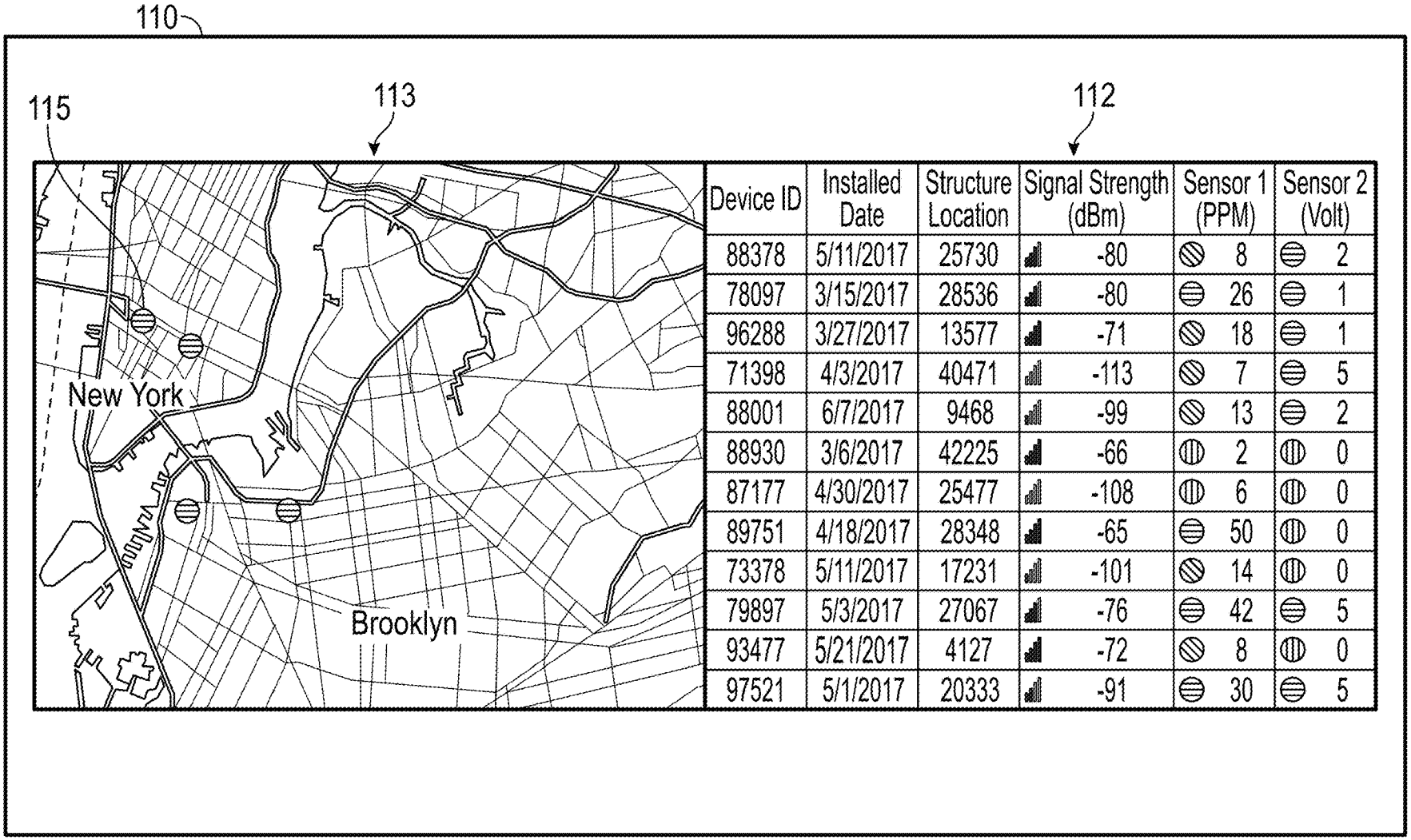
FIG. 9 is a schematic illustration of a display for use with the system of FIG. 8.

In general, controller 58 accepts data from sensor(s) 60 and is given certain instructions for the purpose of comparing the data from sensor(s) 60 to predetermined operational parameters. Controller 58 provides operating signals to the sensor(s) 60 and wireless communications device 64. Controller 58 also accepts data from sensor(s) 60 and power source (62), indicating, for example, whether the sensor(s) 60 are operating in the correct generation rate and pressure range or that the power source has sufficient energy to operate the device 56. In an embodiment, the controller 58 may change the sampling rate of the sensor(s) 60 to have a variable sampling rate or to sample at different rates at different times (e.g. to conserve battery power). In an embodiment, the controller 58 may change the sampling rate of the communications to have a variable transmission rate or to transmit at different rates at different times (e.g. to conserve battery power). In some embodiments, the sampling and transmission rates may be changed based on the season (e.g. summer, autumn, winter, spring). In an embodiment, the sampling and transmission rate may be changed based on a signal (such as from computer 70) in response to an anticipated weather event. The controller 58 compares the operational parameters to predetermined variances (e.g. high temperature) and if the predetermined variance is exceeded, generates a signal that may be used to indicate an alarm to an operator or the computer network 68 (FIG. 8).

The data received from sensor(s) 60 may be displayed on a user interface coupled to controller 58. The user interface may be an LED (light-emitting diode) display, an LCD (liquid-crystal diode) display, a CRT (cathode ray tube) display, or the like. A keypad may also be coupled to the user interface for providing data input to controller 58.

In addition to being coupled to one or more components within device 56, controller 58 may also be coupled to external computer networks such as a local area network (LAN) 68 and the Internet. LAN 68 interconnects one or more remote computers 70 (FIG. 8), which are configured to communicate with controller 58 using a well-known computer communications protocol such as TCP/IP (Transmission Control Protocol/Internet(^) Protocol), RS-232, ModBus, and the like. As shown in FIG. 8, additional devices 56 may also be connected to LAN 68 with the controllers 58 in each of these devices 58 being configured to send and receive data to and from remote computers 70 and other devices 56. In an embodiment, LAN 68 is connected to the Internet. This connection allows controller 58 to communicate with one or more remote computers connected to the Internet. In other embodiments, the LAN 68 may be a wide-area-network, a cellular network, an advanced metering infrastructure (AMI) or the like. In some embodiments, the connection to the LAN 68 may be through concrete or metal.

Controller 58 includes a processing unit 72 having a processor 74 coupled to memory 76. The memory 76 may include a random access memory (RAM) device and a read-only memory (ROM) device. A nonvolatile memory (NVM) 78 may also be coupled to the processing unit 72. The processing unit may also include one or more input/output (I/O) controllers, and an interface device to connect the processing unit 72 to the wireless communications device 62.

The ROM memory device 76 stores an application code, e.g., main functionality firmware, including initializing parameters, and boot code, for processor 74. Application code also includes program instructions for causing processor 74 to execute any remote monitoring device 56 operation control methods, including starting and stopping operation, monitoring predetermined operating parameters and generation of alarms.

NVM device 78 is any form of non-volatile memory such as an EPROM (Erasable Programmable Read Only Memory) chip, a disk drive, or the like. Stored in NVM device 78 are various operational parameters for the application code. The various operational parameters can be input to NVM device 78 either locally, using a keypad or remote computer 70, or remotely via the Internet using remote computer 70. It will be recognized that application code can be stored in NVM device 78 rather than ROM device 76.

Controller 58 includes operation control methods embodied in application code. These methods are embodied in computer instructions written to be executed by processor 74, typically in the form of software. The software can be encoded in any language, including, but not limited to, assembly language, VHDL (Verilog Hardware Description Language), VHSIC HDL (Very High Speed IC Hardware Description Language), Fortran (formula translation), C, C++, C#, Objective-C, Visual C++, Java, ALGOL (algorithmic language), BASIC (beginners all-purpose symbolic instruction code), visual BASIC, ActiveX, HTML (HyperText Markup Language), Python, Ruby and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

Referring now to FIGS. 4-7 an embodiment is shown of the remote monitoring device 56. In this embodiment, the remote monitoring device 56 includes a housing 80 that has a cross section (width and length) that is sized to fit through a slot 82 in the manhole cover 50. The height of the housing 80 is such that the remote monitoring device 56 extends through the slot 82 and at least a portion of the housing 80 is positioned below the manhole cover 50 in the structure 40. In an embodiment, the housing 80 includes a flange 84 on an end. In an embodiment, the housing 80 is sealed to allow operation of the remote monitoring device 56 even if the housing 80 is submerged in water. The flange 84 has a peripheral edge 86 that extends beyond the edge of the slot 82 when the housing 80 is inserted into the slot 82. As a result, the lower surface of the flange 84 rests against the top surface 88 when the remote monitoring device 56 is inserted into the slot 82.

The flange 84 prevents the remote monitoring device 56 from falling into the structure 40. To remove the remote monitoring device 56 the operator may simply pick up the remote monitoring device 56 by the flange 84. Since many structures 40, and manhole covers 50, are located in public streets or sidewalks, in some embodiments it may be desired to secure the remote monitoring device 56 to prevent unauthorized removal. In an embodiment, a fastener 90 extends from the bottom of the flange 84 (e.g. in a direction toward the surface 88 when the housing 80 is inserted into slot 82). The fastener has a body 92 with a length that is longer than the thickness of the manhole cover 50. In an embodiment, on an end of the body 92 opposite the flange 84, a pair of projections 94 extend outward from the body 92. In an embodiment, the projections 94 extend on an angle towards the bottom surface 96 of the manhole cover 50. In an embodiment, the projections 94 are made from a flexible material, such as plastic for example, that allows the projections 94 to deflect as the housing 80 is inserted into the slot 82 and then extend once the projection passes through the slot 82. In another embodiment, the fastener 90 is rotatable. In this embodiment, the operator rotates the fastener 90 such that the projections 94 align with the slot 82. Once the remote monitoring device 56 is inserted, the fasteners 90 are rotated again to dispose the projections 94 out of alignment (e.g. perpendicular to) the slot 82. It should be appreciated that the projections 94 prevent the removal or detachment of the remote monitoring device 56 from the manhole cover 50.

It should be appreciated that the sizing of the housing 80 to fit within a slot 82 provides advantages in that the remote monitoring devices 56 may be quickly installed by utility personnel without removing the manhole cover 50 or entering the structure 40. In some embodiments, multiple remote monitoring devices 56 may be installed in a single manhole cover 50.

Referring now to FIG. 8, an embodiment is shown of a system 100 for collecting data from the remote monitoring devices 56 for display and evaluation at a remote computer 70. In an embodiment, the remote monitoring devices 56 are connected to a network 68 that couples the remote monitoring devices 56 for communication with the remote computer 70. The network 68 may be any known network, such as but not limited to: a wide area network (WAN); a public switched telephone network (PSTN); a local area network (LAN); a global network (e.g. Internet); a virtual private network (VPN); and an intranet for example. The remote monitoring devices 56 may be connected to the network 68 via any known wireless communication system, such as but not limited to; infrared; radio frequency; satellite; microwave; cellular; WiFi (IEEE 802.11); Bluetooth™ (formerly IEEE 802.15.1); RFID (ISO/IEC 20248); NFC (ISO/IEC 18092, ISO/IEC 21481); and Zigbee (IEEE 802.15.4) communications systems for example. The wireless connection between the remote monitoring devices 56 and the network 68 may also be via peer to peer type communications. In one embodiment, the remote monitoring devices 56 form the network directly to the remote computer 70 via a peer to peer communications network.

The computer 70 is suitable for providing communication over cross-coupled links between independently managed compute and storage networks. Computer 70 is only one example of a computer system and is not intended to suggest any limitation as to the scope of use or functionality of embodiments described herein. Regardless, computer 70 is capable of being implemented and/or performing any of the functionality described herein.

Computer 70 is operational with numerous other general purpose or special purpose computing system environments or configurations. Examples of well-known computing systems, environments, and/or configurations that may be suitable for use with computer 70 include, but are not limited to, personal computer systems, server computer systems, thin clients, thick clients, cellular telephones, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer 70 may be described in the general context of computer system-executable instructions, such as program modules, being executed by the computer 70. Generally, program modules may include routines, programs, objects, components, logic, data structures, and so on that perform particular tasks or implement particular abstract data types. Computer 70 may be practiced in distributed cloud computing environments (as described below) where tasks are performed by remote monitoring devices 56 that are linked through the communications network 68. In a distributed computing environment, program modules may be located in both local and remote computer system storage media including memory storage devices.

As shown in FIG. 8, computer 70 is shown in the form of a general-purpose computing device, also referred to as a processing device. The components of computer system may include, but are not limited to, one or more processors or processing units 102, a system memory 104, system storage 106 and a communications interface circuit 108 and a bus (not shown) that couples various system components including system memory 104 to processor 102.

System storage 106 may include a variety of computer system readable media. Such media may be any available media that is accessible by computer system/server 70, and it includes both volatile and non-volatile media, removable and non-removable media. Computer 70 may further include other removable/non-removable, volatile/non-volatile computer system storage media. By way of example only, system storage 106 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to the bus by one or more data media interfaces.

System memory 104 can include computer system readable media in the form of volatile memory, such as random access memory (RAM) and/or cache memory 32. As will be further depicted and described below, memory 104 may include at least one program product having a set (e.g., at least one) of program modules that are configured to carry out the functions of embodiments of the disclosure.

Program/utility, having a set (at least one) of program modules, may be stored in memory 104 by way of example, and not limitation, as well as an operating system, one or more application programs, other program modules, and program data. Each of the operating system, one or more application programs, other program modules, and program data or some combination thereof, may include an implementation of a networking environment. Program modules generally carry out the functions and/or methodologies of embodiments of the invention such as the operational control methods described with respect to FIG. 12.

Computer 70 communicates with one or more external devices such as a keyboard, a pointing device, a display 110, etc.; one or more devices that enable a user to interact with computer 70; and/or any devices (e.g., network card, modem, etc.) that enable computer 70 to communicate with one or more other computing devices. Such communication can occur via Input/Output (I/O) interfaces. Still yet, computer 70 can communicate with one or more networks such as a local area network (LAN), a general wide area network (WAN), and/or a public network (e.g., the Internet) via communications interface circuit 108 (e.g. network adapter). It should be understood that although not shown, other hardware and/or software components could be used in conjunction with computer 70. Examples include, but are not limited to: microcode, device drivers, redundant processing units, external disk drive arrays, RAID systems, tape drives, and data archival storage systems, etc.

It should be appreciated that while the computer 70 is illustrated and described as being a single device, this is for exemplary purposes and the claims should not be so limited. In other embodiments, the functionality of computer 70 may be distributed to multiple devices for example. Further still, the functionality of computer 70 may be performed or displayed simultaneously for example. In some embodiments, the computer 70 is disposed in a central location of the electrical utility operations. Also, the computer 70 may sometimes be referred to as a "remote" computer, as used herein that means that the computer 70 may be geographically separated from at least some of the remote monitoring devices.

In operation, the remote monitoring devices 56 transmit data, such as that acquired by sensors 60 for example, on a periodic or aperiodic basis to the remote computer 70. In an embodiment, the remote monitoring device 56 transmits sensor data to the computer 70 for evaluation. In another embodiment, the remote monitoring device 56 compares the sensor data to predetermined thresholds and transmits a signal to the computer 70. The information transmitted in the signal may include, but is not limited to, the type of parameter monitored, the current measurement of the parameter, the threshold value, the rate of change of the measured parameter, differential change of the measured parameter from an average, visible and IR images of the structure 40, and a sound recording for example.

Figure 10:
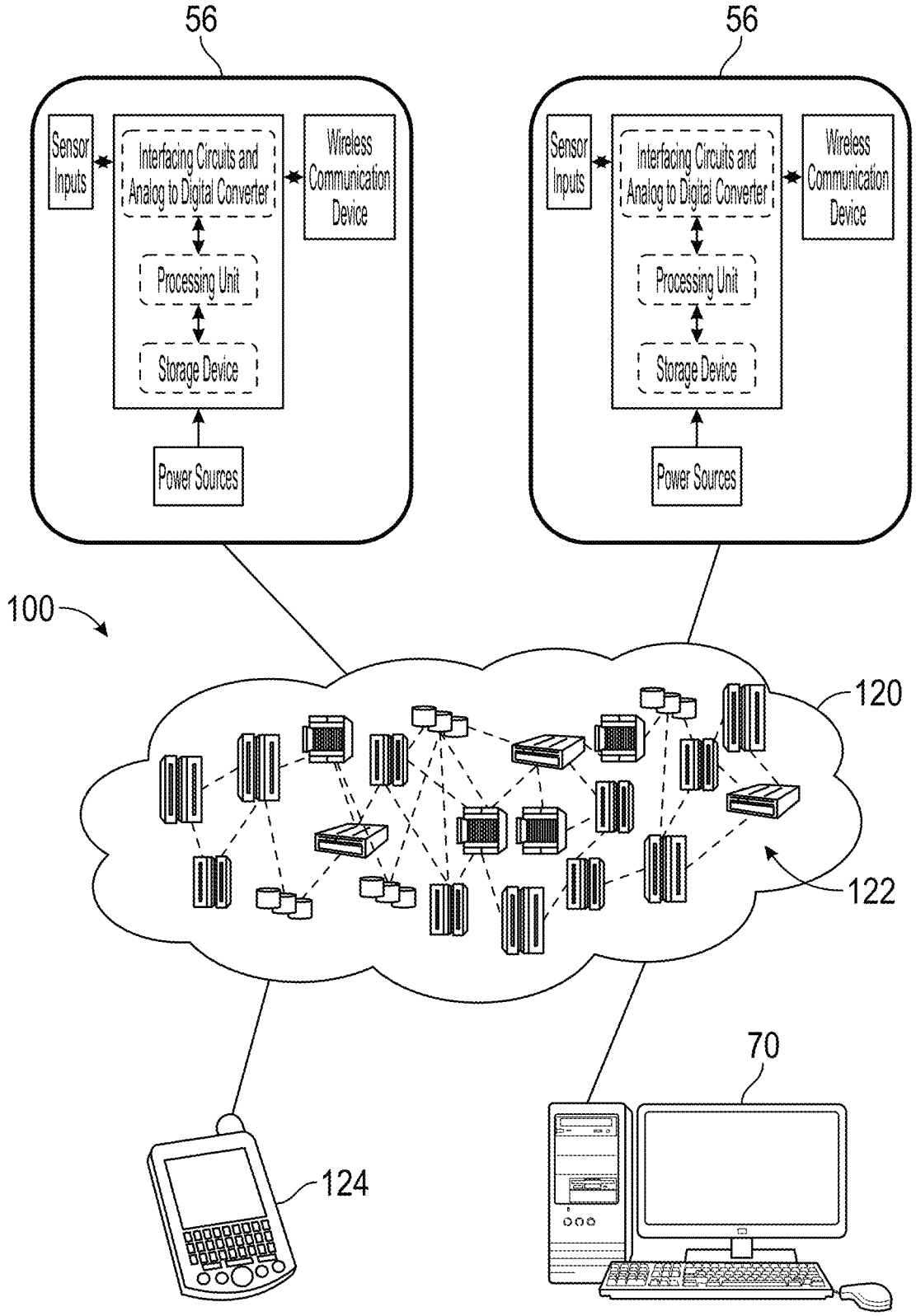
FIG. 10 is a schematic illustration of the system of FIG. 8 using distributed or cloud computing environment.

As discussed in more detail with reference to FIG. 12, the computer 70 may display all or a subset of the information transmitted from the remote monitoring devices on display 110. Referring now to FIG. 10, a display is shown that may be used with the system 100. In an embodiment, the display 110 may include a plurality of graphical elements 112. Each of the graphical elements 112 represents one of the remote monitoring devices 56 that have been installed in structures 40. In an embodiment, the display 112 includes an image or representation 113 of the geographic region that the remote monitoring devices are installed (or a portion thereof). In an embodiment. symbols or text 115 that correspond with the elements 112 are arranged at a location on the image where the corresponding remote monitoring device 56 is located.

In an embodiment, when a signal is received by the computer 70 indicating that a measured parameter is outside of a predetermined criterion (e.g. the parameter has crossed a threshold), the computer 70 changes the graphical element 112 associated with that structure 40 to alert the operator of computer 70. In an embodiment, the operator may use the user interface of computer 70 to select the graphical element 112 and obtain additional information on the operational status of the structure 40. In an embodiment, the computer 70 changes the color of the graphical element 112 based at least in part on the measured parameters. In an embodiment, the operator may be able to suppress an alarm from a selected remote monitoring device 56. For example, where a water level in a structure 40 is greater than a threshold, the operator may suppress the alarm. In an embodiment, the alarm may be suppressed for a predetermined amount of time and then reset.

The computer 70 may compare the information to predetermined criterion and determine a priority level for repair or maintenance of the structure 40. In an embodiment, the computer 70 may have a database that includes operational personnel. The information in the operational personnel database may include, but is not limited to, the skills or qualifications of the operational personnel, their availability (e.g. are they currently working), contact information, their current location, and tools or equipment that they currently have. Based at least in part on the priority level and the information in the database, the computer 70 may automatically transmit a signal to operational personnel with instructions on which structure they should go to (e.g. a street location/address) and what repair or maintenance should be performed. In another embodiment, the computer 70 displays the proposed operating personnel that are recommended to be dispatched to the structure 40 and an operator of the computer 70 manually or electronically provides instructions to the operational personnel. In another embodiment, the computer 70 displays the condition status of structures adjoining the structure the operating personnel are working on. In another embodiment, the computer 70 alerts operating personnel of an undesired condition in the immediate or adjoining structures operating personnel are working on.

Figure 2B:
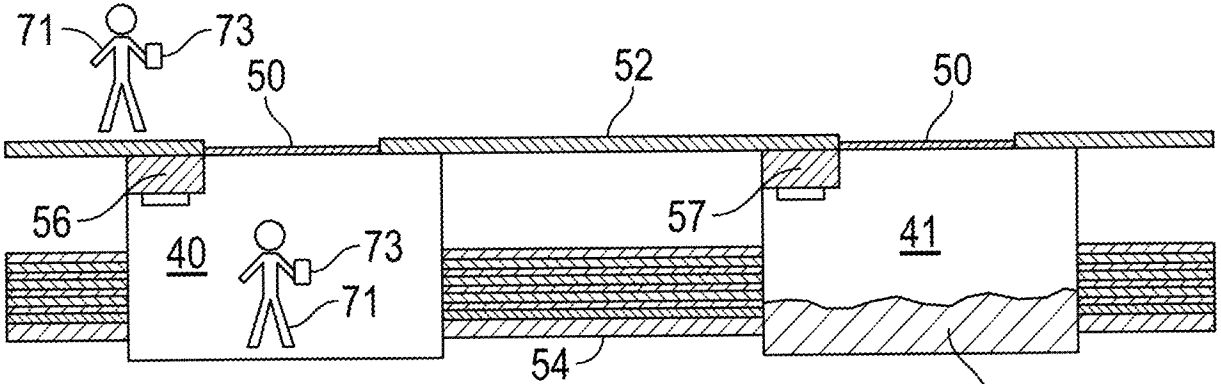
Figure 2C:
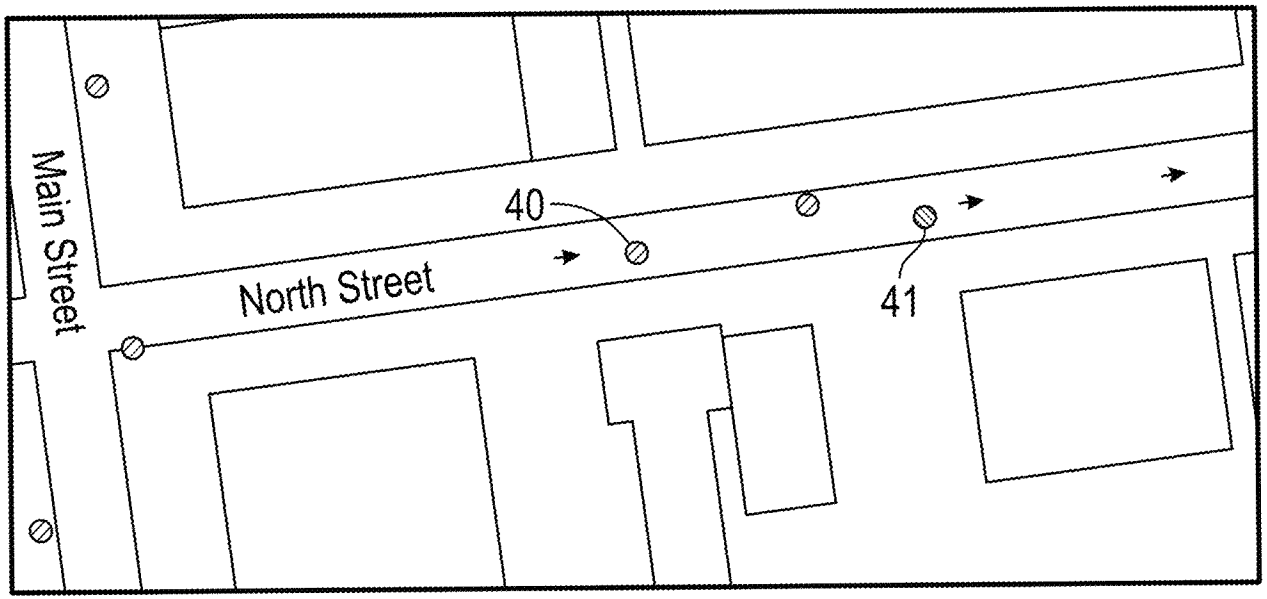
FIG. 2C is a map illustrating the locations of the subterranean spaces or structures of FIG. 2B.

In the example of FIG. 2B and FIG. 2C, operating personnel 71 may be working in the structure 40. While the work is being performed, the system may continue to monitor the conditions within the structure 40, but also the adjoining structures, such as structure 41. The conditions within structure 41 is monitored by remote monitoring device 56 and the structure 41 is access through cover 51. In the event that an undesired condition occurs in structure 41, such as a water level 43 being above a predetermined threshold, the computer 70 transmits a signal to the operating personnel 71 to alert them of the undesired condition. In an embodiments, each of the operating personnel 71 have a mobile computing device, such as a cellular phone for example, to which the computer 70 is configured to transmit the signal.

In an embodiment, the predetermined criterion may include a sum of the priority value and an asset quality. In an embodiment where the structure 40 includes equipment such as electrical cables or conductors 54, the asset qualities include one or more of population density, cable density, cable age, and cable failure rate. In another embodiment, the predetermined criterion may include at least one or more of population density, cable density, cable age, and cable failure rate. In another embodiment, machine learning on sensor and asset data can be used to determine the criterion.

In an embodiment, an actionable priority value is based on a type of measured parameter that crosses a threshold. In an embodiment, the priority value from high to low comprise: combustible gas, stray and contact voltage, infrared temperature, ambient air temperature, particulate, and electrical arcing. In an embodiment, each of the priority values has a high set value and a low set value. In an embodiment, a priority level is based at least in part on the rate of change of the measured parameter. In an embodiment, the priority level is increased based on the rate of change crossing a threshold.

Figure 11:
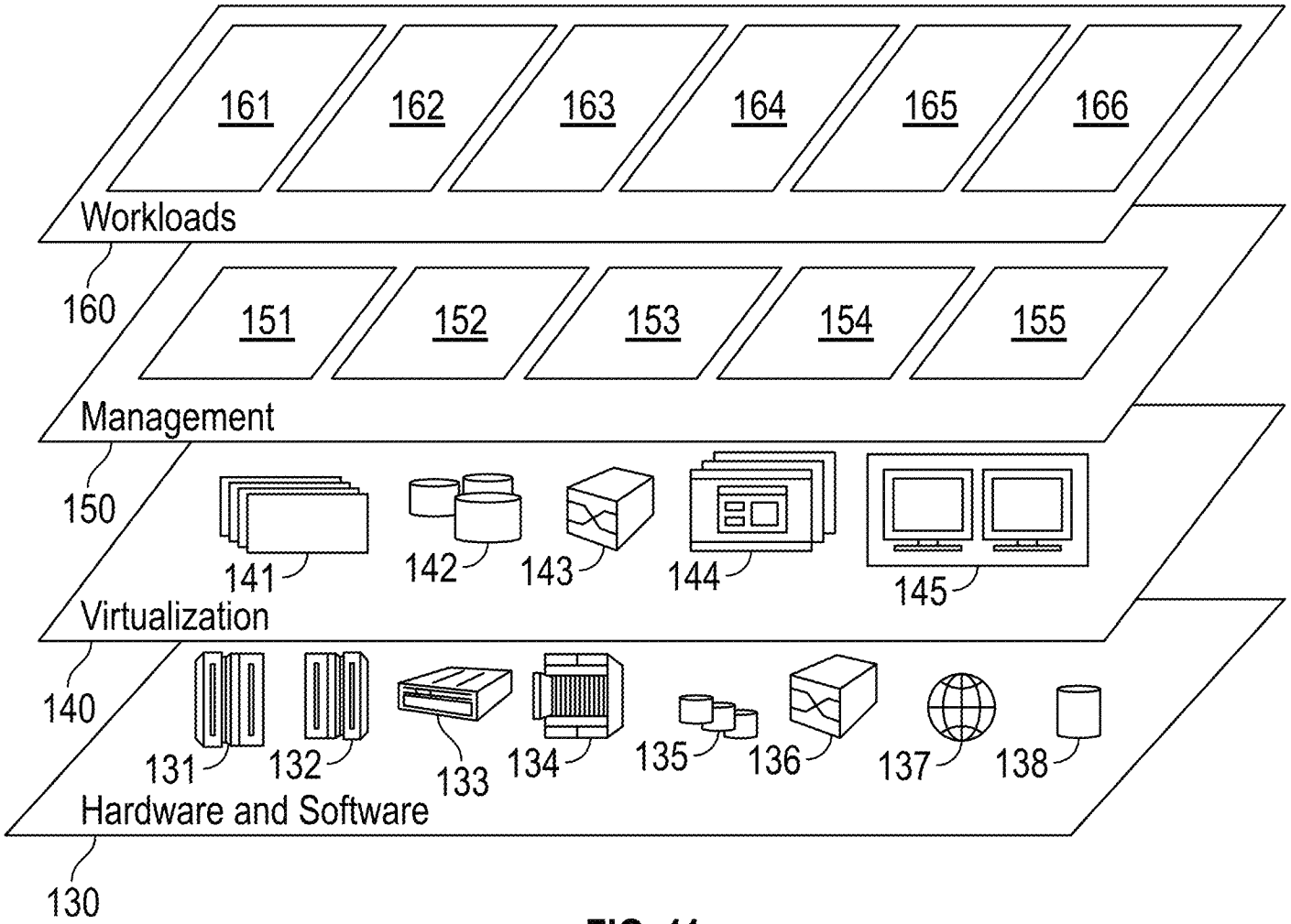
FIG. 11 is a schematic illustration of abstract model layers of the cloud computing environment of FIG. 10.

Referring now to FIG. 10 and FIG. 11, the system 100 may be implemented in a cloud computing environment. Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as Follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as Follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as Follows:

Private cloud: the cloud infrastructure is operated solely for an organization (e.g the electrical utility). It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 10, illustrative cloud computing environment 120 is depicted. As shown, cloud computing environment 120 comprises one or more cloud computing nodes 122 with which computing devices used by cloud users, such as, for example, personal digital assistant (PDA), tablet, laptop smart phone or cellular telephone 124, computer 70, or remote monitoring devices 56 may communicate. It should be appreciated that the computing device(s) 124 may be carried by operation personnel. The instructions on which structure 40 they should perform maintenance or repairs discussed herein may be transmitted from the computer 70 to the computing device 124 via the cloud computing environment 120. In addition, the computing device 124 may receive conditions of the work structure and surrounding structures. The conditions may generate alarms or other audio or visual indicators on the cellular telephone. Nodes 122 may communicate with one another. They may be grouped (not shown) physically or virtually, in one or more networks, such as Private, Community, Public, or Hybrid clouds as described hereinabove, or a combination thereof. This allows cloud computing environment 120 to offer infrastructure, platforms and/or software as services for which a cloud consumer does not need to maintain resources on a local computing device. It is understood that the types of computing devices 56, 70, 124 shown in FIG. 10 are intended to be illustrative only and that computing nodes 122 and cloud computing environment 120 can communicate with any type of computerized device over any type of network and/or network addressable connection (e.g., using a web browser).

Referring now to FIG. 11, a set of functional abstraction layers provided by cloud computing environment 120 (FIG. 10) is shown. It should be understood in advance that the components, layers, and functions shown in FIG. 11 are intended to be illustrative only and embodiments of the invention are not limited thereto. As depicted, the following layers and corresponding functions are provided:

Hardware and software layer 130 includes hardware and software components. Examples of hardware components include: mainframes 131; RISC (Reduced Instruction Set Computer) architecture based servers 132; servers 133; blade servers 134; storage devices 135; and networks and networking components 136. In some embodiments, software components include network application server software 137 and database software 138.

Virtualization layer 140 provides an abstraction layer from which the following examples of virtual entities may be provided: virtual servers 141; virtual storage 142; virtual networks 143, including virtual private networks; virtual applications and operating systems 144; and virtual clients 145.

In one example, management layer 150 may provide the functions described below. Resource provisioning 151 provides dynamic procurement of computing resources and other resources that are utilized to perform tasks within the cloud computing environment. Metering and Pricing 152 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 153 provides access to the cloud computing environment for consumers and system administrators. Service level management 154 provides cloud computing resource allocation and management such that required service levels are met. Service Level Agreement (SLA) planning and fulfillment 155 provide pre-arrangement for, and procurement of, cloud computing resources for which a future requirement is anticipated in accordance with an SLA.

Workloads layer 160 provides examples of functionality for which the cloud computing environment may be utilized. Examples of workloads and functions which may be provided from this layer include: mapping and navigation 161; electrical distribution network management 162; operating personnel management 163; data analytics processing 164; transaction processing 165; and structure 40 analysis and prioritization processing 166.

Figure 12:
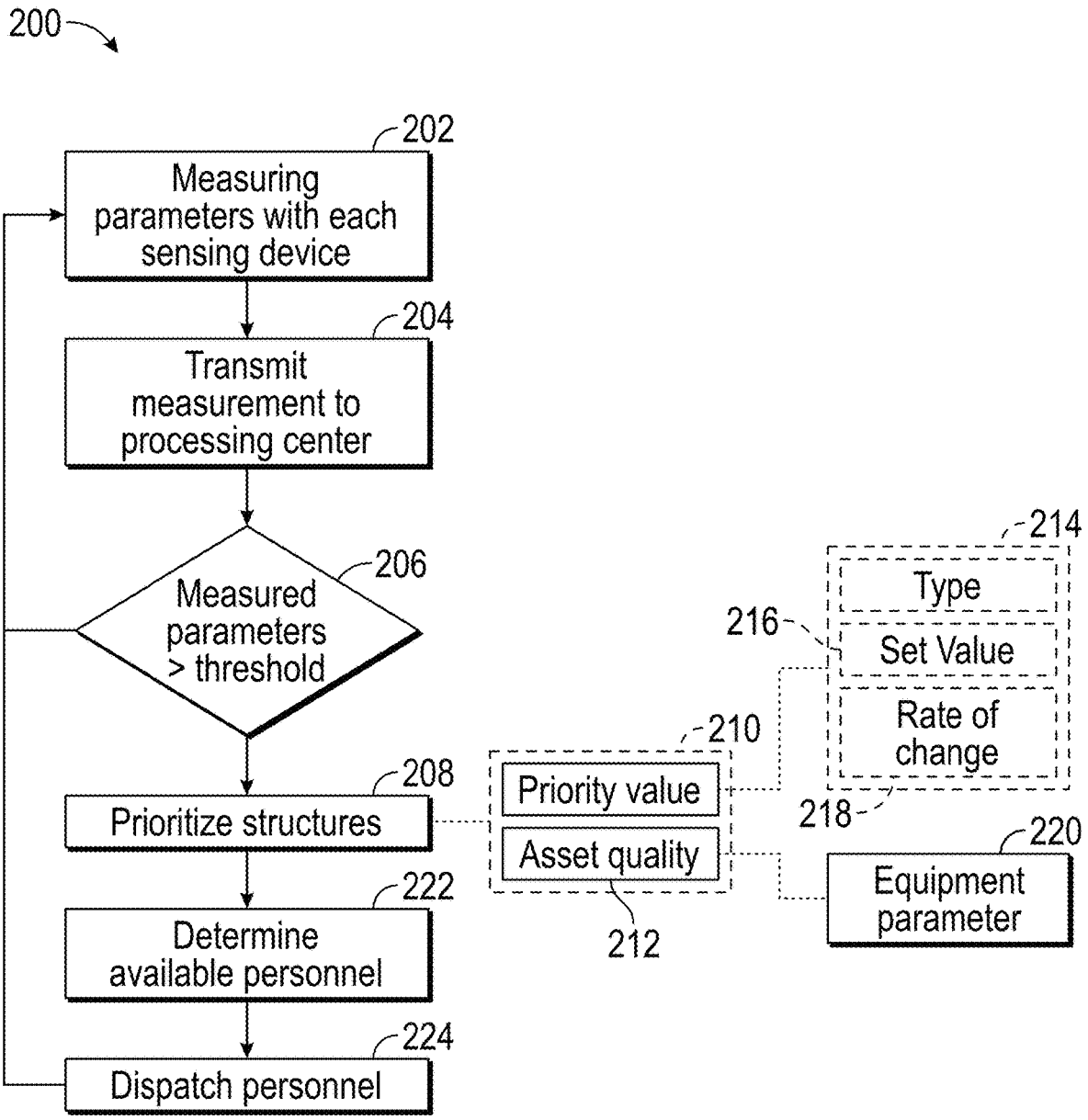
FIG. 12 is a flow diagram of a method of monitoring the electrical utility network and the dispatching of utility personnel.

Referring now to FIG. 12, a method 200 is shown for prioritizing the maintenance or repair of equipment, such as conductors 54 in structures 40. The method 200 begins in block 202 where parameters are measured by the sensors 60 at each of a plurality of remote monitoring devices 56. The measurements may be performed on a periodic, aperiodic or variable sampling rate basis. As discussed herein, the sensors 60 may include, but are not limited to, devices that measure combustible gas, stray voltage, contact voltage, infrared signatures, temperatures, particulate size, water levels, electrical arcing, or a combination of the foregoing. In one embodiment, the sensors include a pyrometer. The measured parameters include, but are not limited to, lower explosive limit (LEL), air temperature, conductor temperature, equipment temperature, temperature differentials, temperature gradients, stray voltage, contact voltage, particulate size, light levels, sound pressure, opacity, refractive index, and fluorescence.

The method 200 then proceeds to optional block 204 where the measured parameter values are transmitted to the computer 70, such as via network 120 for example. In on embodiment, all of the measured parameter values are transmitted to the computer 70. In another embodiment, an analysis of the measured parameters is performed at least partially by the processing unit 72 of the remote monitoring device 56. The method 200 then proceeds to query block 206 where the measured parameters are compared with predetermined thresholds. The comparison of the measured parameters and predetermined thresholds may be performed either at the remote monitoring device 56, at the computer 70, or a combination thereof. Where the comparison is performed by the remote monitoring device 56, the remote monitoring device 56 may transmit a signal to the computer 70, the signal may include the measured parameter, an indicator that the predetermined threshold has been crossed, a rate of change of the measured parameter, or a combination of the foregoing.

In an embodiment, the measured parameter and threshold may include: a combustible gas being between 0.5% LEL and 1.0% LEL; a cable surface temperature and threshold between 75 C and 90 C; an ambient air temperature and threshold being between 50% of a cable rating and 75% of the conductor 54 rating; a stray voltage being and threshold between 1V and 5V; a contact voltage and threshold being between 1V and 5V; a particulate size and threshold being between 1 micron and 10 micron; or a combination of the foregoing. In an embodiment, the measured parameter and threshold is a temperature differential equal to or greater than 17 C. In an embodiment, the measured parameter and threshold is a temperature equal to or greater than 90 C. In an embodiment, the measured parameter and threshold is a temperature gradient being substantially uniform along a predetermined length of the conductor 54. In an embodiment, the measured parameter and threshold is a sound pressure level equal to or greater than 90 dB. In an embodiment, the measured parameter and threshold is an opacity measured from a visible image, the opacity threshold being equal to or greater than 5%. In an embodiment, the measured parameter includes a temperature differential between two predetermined locations on the conductor 54.

The method 200 then proceeds to block 208, where the prioritization is determined for the structures 40 where maintenance or repair is desired. The prioritization being based at least in part on the information transmitted by the remote monitoring devices 56. In an embodiment, the prioritization is based at least in part on a predetermined criterion. In an embodiment, the predetermined criterion may include one or more of population density, cable density, cable age, and cable failure rate. In an embodiment, the predetermined criterion may include a sum of a priority value 210 and an asset quality 212.

The priority value 210 is a numerical value based at least in part on the type 214 of measured parameter that crossed a threshold. In an embodiment, the priority values 210 from high (value) to low (value) are combustible gas, stray and contact voltage, infrared temperature, ambient air temperature, particulate size, and electrical arcing. In an embodiment, each of the priority values includes a high set value and a low set value 216. In an embodiment, the priority value may be increased or decreased based on the rate of change 218 of the measured parameter.

In an embodiment, the asset quality may be based at least in part on equipment parameters (e.g. age, failure rate) 220. In an embodiment where the equipment includes the conductor 54, the asset quality may include one or more of population density, conductor density, conductor age, and conductor failure rate.

With the priority level determined for each of the structures 40, the method 200 proceeds to block 222 where the availability of the operational personnel is determined. As discussed herein, in one embodiment, the computer 70 has access to a database of operational personnel. The database includes, but is not limited to, the skills or qualifications of the operational personnel, their availability (are they currently working), contact information, their current location, and tools or equipment that they currently have. The method 200 then proceeds to block 224 where the available operational personnel are assigned to structures 40 and instructions are transmitted to the operational personnel. In an embodiment, the transmitting of instructions includes transmitting the instructions to a mobile computing device (e.g. a smart phone or cellular phone, a tablet computer, a laptop computer, or a personal digital assistant) being carried or in the possession of the operational personnel. In an embodiment, the assigning of operational personnel to a structure is based at least in part on the priority level of the structure and the current geographic location of the operational personnel relative to the structure 40. Once the instructions are received, the operational personnel are dispatched to the assigned structures 40 and perform the desired procedures or repairs. The method 200 then loops back to block 202 and the method 200 continues.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A method of prioritizing and dispatching utility personnel to one or more of a plurality of structures containing utility components, the method comprising:

measuring measured parameters at each of a plurality of structures that are distributed within a geographic region, each of the plurality of structures having a plurality of sensors;

transmitting, on a periodic or aperiodic basis, the measured parameters to one or more processors located at a processing center remotely located from the plurality of structures;

comparing the measured parameters to predetermined thresholds;

determining a first plurality of structures, each having at least one measured parameter that crossed a threshold;

prioritizing with the one or more processors the first plurality of structures for repair, the prioritizing being based at least in part a priority value;

determining with the one or more processors a plurality of operational personnel for repairing the first plurality of structures;

selecting one or more of the plurality of operational personnel;

dispatching the one or more of the plurality of operational personnel to the first plurality of structures based on the prioritization; and wherein the dispatching of the operational personnel includes transmitting instructions to a mobile computing device associated with the selected operational personnel.

2. The method of claim 1, wherein the priority value is based at least in part on the measured parameters.

3. The method of claim 1, wherein the selecting of the one or more operational personnel is based at least in part on skills or qualifications of the operational personnel, availability of the operational personnel, contact information of the operational personnel, a current location of the operational personnel, and tools or equipment the operational personnel currently have in their possession.

4. The method of claim 1, wherein the selecting of the operational personnel is further based at least in part on the priority value and a current geographic location of the selected operational personnel.

5. The method of claim 1, wherein the priority value is based at least in part on the type of measured parameter that crosses the threshold.

6. The method of claim 1, further comprising changing the priority value based at least in part on a rate of change of the measured parameter that crosses the threshold.

7. A system for monitoring a plurality of structures containing utility components, the system comprising:

a plurality of sensing devices, each being disposed within one of the plurality of structures, the plurality of sensing devices being distributed within a geographic region, each of the sensing devices having a plurality of sensors for measuring parameters within the associated structure, the measured parameters being combustible gas levels, stray voltage, and infrared signatures;

a display operably coupled to the plurality of sensing devices, the display being positioned remotely from the plurality of sensing devices;

wherein each sensing device includes a controller that is coupled for communication between the plurality of sensors associated with the sensing device and the display, the controller having one or more processing units that are coupled to the plurality of sensors associated with the sensing device by a data transmission media;

one or more processors coupled for communication to the plurality of sensing devices and the display, wherein the one or more processors are responsive to executable instructions when executed on the processor for performing a method comprising:

receiving signals representing the measured parameters;

comparing the measured parameters to predetermined thresholds;

displaying on the display a plurality of indicators, each indicator representing one of the plurality of sensing devices;

alerting an operator when at least one of the measured parameters crosses the associated predetermined threshold; and wherein the data transmission media includes a wireless connection between at least one of the plurality of sensors and the one or more processing units.

8. The system of claim 7, wherein the wireless connection is one of a radio or infrared signal transmission system.

9. The system of claim 7 wherein the sensing device further includes a battery electrically coupled to at least one of the plurality of sensors, the processing unit being responsive to executable computer instructions for changing a sampling rate of the at least one of the plurality of sensors based at least in part on a energy level of the battery.

10. A system for monitoring a plurality of structures containing utility components, the system comprising:

a plurality of sensing devices, each being disposed within one of the plurality of structures, the plurality of sensing devices being distributed within a geographic region, each of the sensing devices having a plurality of sensors for measuring parameters within the associated structure, the measured parameters being combustible gas levels, stray voltage, and infrared signatures;

a display operably coupled to the plurality of sensing devices, the display being positioned remotely from the plurality of sensing devices;

wherein each sensing device includes a controller that is coupled for communication between the plurality of sensors associated with the sensing device and the display, the controller having one or more processing units that are coupled to the plurality of sensors associated with the sensing device by a data transmission media;

one or more processors coupled for communication to the plurality of sensing devices and the display, wherein the one or more processors are responsive to executable instructions when executed on the processor for performing a method comprising:

receiving signals representing the measured parameters;

comparing the measured parameters to predetermined thresholds;

displaying on the display a plurality of indicators, each indicator representing one of the plurality of sensing devices;

alerting an operator when at least one of the measured parameters crosses the associated predetermined threshold; and wherein the data transmission media includes a physical connection between at least on of the plurality of sensors and the one or more processing units.

11. The system of claim 10, wherein the physical connection is one of a twisted pair wiring, coaxial cable, or fiber optic cable.

* * * * *